US005279776A

United States Patent [19]

Shah

[11] Patent Number: 5,279,776

[45] Date of Patent: Jan. 18, 1994

[54] METHOD FOR MAKING STRONG DISCRETE FIBERS

[75] Inventor: Ashok H. Shah, Chesterfield, Va.

[73] Assignee: E. I. Du Pont de Nemours and Company, Wilmington, Del.

[21] Appl. No.: 762,095

[22] Filed: Sep. 17, 1991

[51] Int. Cl.[5] ..... B22D 23/08

[52] U.S. Cl. ..... 264/12; 264/140; 264/167; 428/364

[58] Field of Search ..... 264/12, 14, 22, 140, 264/167

[56] References Cited

U.S. PATENT DOCUMENTS

| | | | |
|---|---|---|---|
| 3,081,519 | 3/1963 | Blades et al. | 28/81 |
| 3,227,794 | 1/1966 | Anderson et al. | 264/205 |
| 3,920,509 | 11/1975 | Yonemori | 162/157 R |
| 4,025,593 | 5/1977 | Raganato et al. | 264/94 |
| 4,105,727 | 8/1978 | Zanella et al. | 264/12 |
| 4,189,455 | 2/1980 | Raganato et al. | 264/12 |
| 4,211,737 | 7/1980 | Di Drusco et al. | 264/12 |
| 4,352,650 | 10/1982 | Marshall | 425/174.8 E |
| 4,600,545 | 7/1986 | Galli et al. | 264/11 |
| 4,642,262 | 2/1987 | Piotrowski et al. | 428/296 |

FOREIGN PATENT DOCUMENTS 2005592 3/1982 United Kingdom .

*Primary Examiner*—Patrick J. Ryan
*Assistant Examiner*—Richard C. Weisberger

[57] ABSTRACT

A method for making strong discrete fibers by flash spinning a polymer solution through a spinneret. A gaseous fluid is injected in parallel into the core of the polymer solution prior to passage through the spinneret. The high shear forces the gaseous fluid exerts on the polymer solution cause highly oriented, strong discrete fibers to be produced upon flashing through the spinneret rather than continuous fibers.

7 Claims, 3 Drawing Sheets

METHOD FOR MAKING STRONG DISCRETE FIBERS

FIELD OF THE INVENTION

The present invention relates to a method for making strong discrete fibers by flash spinning a single or two phase polymer solution through a spinneret. In particular, the invention relates to injecting a gaseous fluid into the core of the polymer solution to produce well oriented, strong, discrete fibers upon flashing through the spinneret.

BACKGROUND OF THE INVENTION

In the current commercial process used for making polyethylene film-fibril sheets (e.g., Tyvek® spunbonded polyolefin sheets commercially available from E. I. du Pont de Nemours and Co. of Wilmington, Del.), continuous fibers having a desired strength, fineness and surface area are produced by flash spinning a solution of high density polyethylene (HDPE) in a trichlorofluoromethane ("Freon 11" or "F-11") spin agent. The importance of using a spinneret and tunnel configuration on imparting key properties, such as tenacity and elongation to break, to the flash spun, continuous fibers is described in U.S. Pat. No. 3,081,519 (Blades et al.), U.S. Pat. No. 3,227,794 (Anderson et al.) and U.S. Pat. No. 4,352,650 (Marshall). In particular, Marshall discusses the optimization of tunnel configuration for increasing the fiber tenacity (e.g., from 4.2 to 5.2 grams per denier) of flash spun, continuous fibers, while eliminating certain defects caused by high throughput conditions under non-optimum tunnel configurations. In general, fiber tenacity can be increased by as much as 1.3 to 1.7 times by using a tunnel at the spinneret exit. However, although these prior art methods work well for making continuous fibers, there is no mention of how to make strong discrete (i.e., discontinuous) fibers using flash spinning equipment.

In the past, various methods have been suggested for making discrete fibers using a secondary fluid. However, none of these methods produce discrete fibers having acceptable strength for such things as paper and cement reinforcment applications. The major use of these prior art discrete fibers has been as a fusing component in cellulosic pulp. Due to this use, no effort has been made to orient the polymer matrix during flash spinning and to fragment the matrix at the appropriate moment. Examples of these prior art methods include U.S. Pat. Nos. 4,025,593; 4,600,545; 4,189,455; and 4,642,262.

Clearly, what is needed is a method for making strong discrete fibers that does not have the problems and deficiencies inherent in the prior art. In particular, it is an object of the present invention to produce strong discrete fibers of a desired quality (e.g., strength, average length, fineness and surface area) using standard flash spinning equipment. Other objects and advantages of the invention will become apparent to those skilled in the art upon reference to the drawings and the detailed description of the invention which hereinafter follow.

SUMMARY OF THE INVENTION

In accordance with the present invention, there is provided a method for making strong discrete fibers from a polymer solution by flash spinning. The key to the invention is in the use of a gaseous fluid in combination with the polymer solution to produce highly oriented, strong, discrete fibers rather than strong, continuous fibers at the time flash spinning occurs.

The method comprises the steps of:

(a) preparing a polymer solution of 4–25 wt. % polymer, preferably high density polyethylene or high density polypropylene, and 75–96 wt. % flash spinning agent at a temperature between 130° and 260° C. and a pressure between 300 and 2500 psig;

(b) introducing the polymer solution into a chamber along the chamber wall while simultaneously injecting, into the center of the chamber, a gaseous fluid in the same direction as the polymer solution and at a pressure substantially equal to the pressure of the polymer solution to sufficiently balance the polymer solution pressure so that back flow does not occur within the chamber, the gaseous fluid being injected into the chamber in a direction parallel to the introduction of the polymer solution; and (c) flash spinning the polymer solution and the gaseous fluid through a spinneret into a region of substantially lower pressure and temperature.

As used herein, the term "strong" means that the flash spun discrete fibers have a zero span strength of at least 13 psi when formed into a 1.6 oz/yd$^2$ wet-laid sheet. Typically, the discrete fibers made by the inventive method have a strength of about 60–80% of the strength of continuous HDPE fibers flash spun with trichlorofluoromethane (i.e., "F-11") in the standard commercial process for making Tyvek® spunbonded polyolefin sheets.

As used herein, the terms "flash spinning agent or spin agent" mean a liquid that is suitable for forming high temperature, high pressure polymer solutions. Suitable liquids are defined and exemplified in U.S. Pat. No. 3,081,519 (Blades et al.), the entire contents of which are incorporated herein by reference.

As used herein, the term "gaseous fluid" means that the fluid injected into the core of the polymer solution within the chamber is a vapor or a gas and not a liquid when it reaches the spinneret where expansion and interaction begin to occur. Non-limiting examples of suitable gaseous fluids include nitrogen, air, argon and steam.

The highly oriented, strong, discrete fibers produced by the inventive method are useful in numerous pulp applications, such as papermaking and cement reinforcement.

DETAILED DESCRIPTION OF THE PREFERRED EMBODIMENTS

In the current commercial process for flash spinning Tyvek® polyolefin sheets, strong, continuous fibers are produced by flashing a two phase polyethylene solution through a spinneret and into a very low pressure tunnel. The tunnel provides directionality to the flash spun fiber strands as well as 30–60% additional strength to the resulting flash spun continuous fibers.

The inventive method is a modification of the above-described continuous flash spinning process. In the method of the invention, a gaseous fluid is injected into the core of the polymer solution within a chamber just prior to the spinneret. This causes the polymer solution to travel along the walls of the chamber (typically a letdown chamber positioned just before the spinneret) while the gaseous fluid travels in a parallel direction within the center of the chamber surrounded by the polymer solution. Thus, both the polymer solution and the gaseous fluid move in parallel and in the same direction just before they reach the spinneret. The gaseous fluid applies very high shear to the polymer solution at the spinneret which makes the polymer solution layer thinner and more prone to fragmentation.

As the polymer solution and gaseous fluid exit the spinneret and expand, a very thin walled, tubular, continuous form appears. Due to the high shear forces, the form also gains additional polymer chain orientation and thus strength as it exits the spinneret. At the moment of expansion, discrete fibers begin to form due to the lateral expansion of the gaseous fluid at the core of the polymer solution tubular form. Intense turbulence created by interactions between the flashing spin agent gases and the laterally expanding gaseous fluid causes the highly oriented polymer matrix to become fragmented. This causes strong, discrete fibers to be formed rather than continuous fibers.

As will be demonstrated in the Examples which follow, in order for strong, discrete fibers to be produced, the gaseous fluid must be a gas or a vapor and not a liquid when the polymer solution and gaseous fluid reach the spinneret where expansion and interaction begin to occur. Moreover, in order to develop a very high shear force, the gaseous fluid and the polymer solution must travel in parallel and in the same direction. As noted above, this is to be contrasted with prior art methods for making discrete fibers wherein an impinging fluid is directed transversely into the polymer solution. In these prior art methods, the impinging fluid (often a liquid) and the polymer solution never move together in the same parallel direction.

Figure 1:
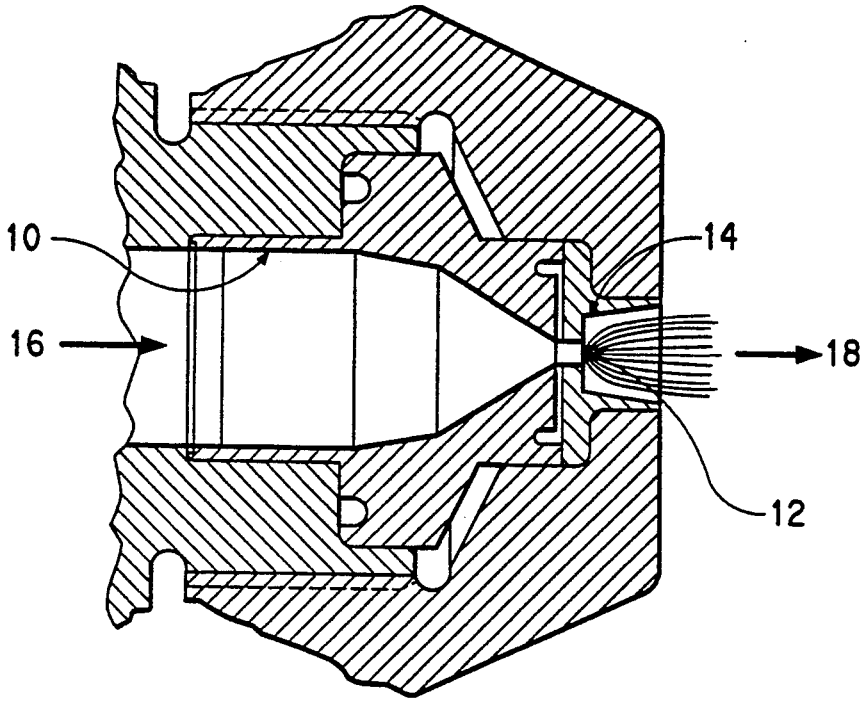
FIG. 1 is a cross-sectional view of a standard spinneret assembly used in making continuous fibers from a polymer solution.

Referring now to the drawings, wherein like reference numerals indicate like elements, FIG. 1 shows a standard spinneret used for flash spinning continuous fibers. The standard spinneret assembly contains a chamber 10, a spinneret 12 and a tunnel 14. The assembly is described in greater detail in U.S. Pat. No. 4,352,650 (Marshall), the entire contents of which are incorporated by reference herein. In the standard spinneret assembly, a polymer solution 16 is passed through chamber 10 and spinneret 12 and into a region of substantially lower temperature and pressure. The tunnel 14 affects fiber orientation and thus increases the strength of the resulting continuous fibers 18.

Figure 2:
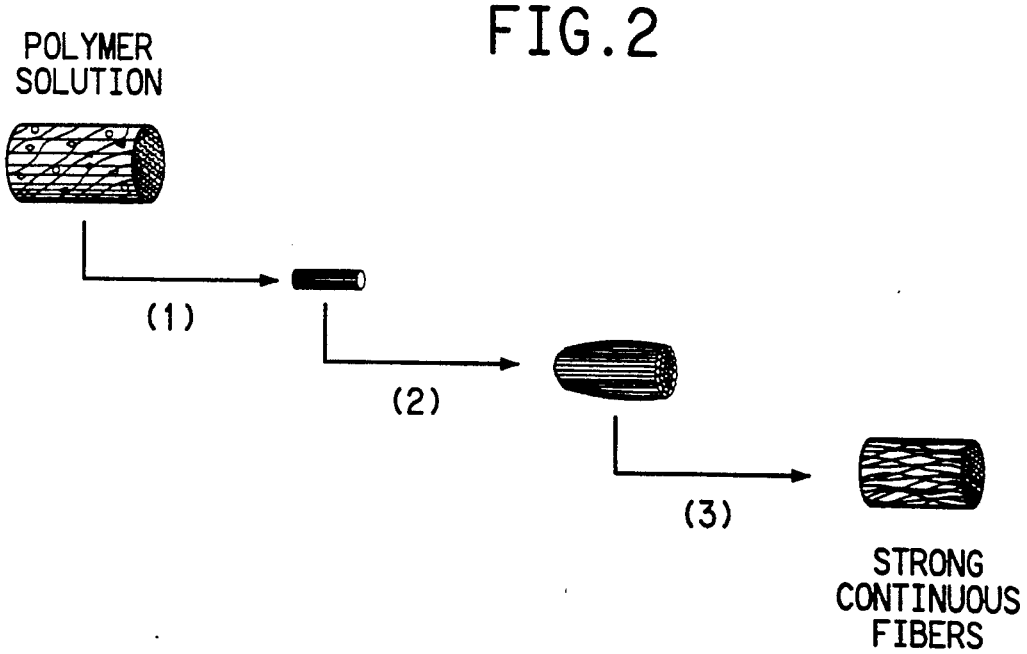
FIG. 2 shows the believed physical state of the polymer used in the assembly of FIG. 1 at various stages during the flash spinning process as the polymer goes from the solution phase to strong, continuous fibers.

FIG. 2 diagramatically illustrates how it is believed the polymer solution physically changes as it goes through the standard spinneret assembly of FIG. 1. Position (1) is at the spinneret, position (2) is at the tunnel entrance and position (3) is at the tunnel exit. The polymer solution exits the spinneret as highly oriented, strong, continuous fibers.

Figure 3:
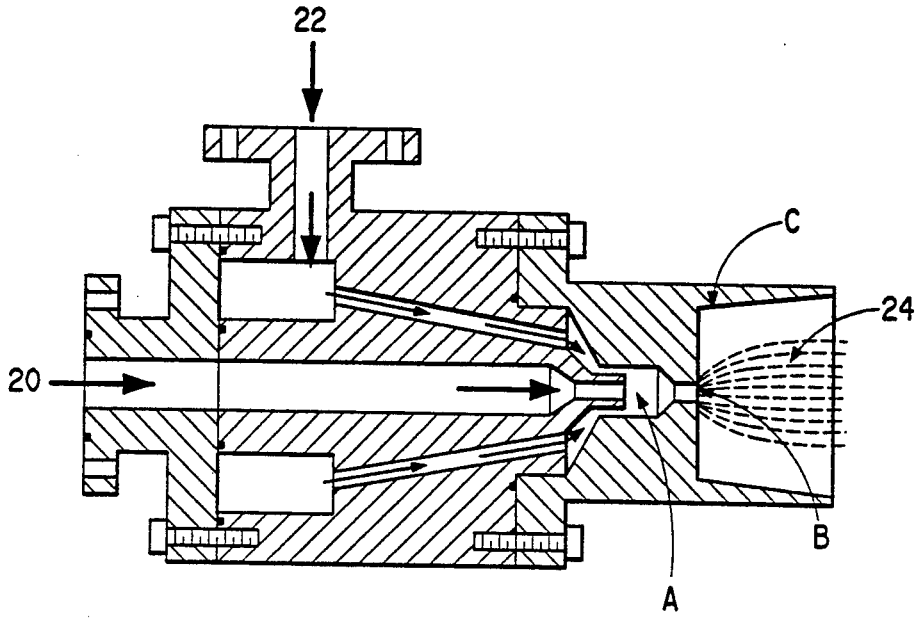
FIG. 3 is a cross-sectional view of a spinneret assembly used in making discrete fibers from a polymer solution in accordance with the invention.

FIG. 3 shows a preferred spinneret assembly for carrying out the inventive method. A stream of a gaseous fluid 20 (e.g., steam, air, argon or nitrogen) is injected into the center (i.e., core) of a stream of high viscosity polymer solution 22 in chamber "A". A tubular form of polymer solution results along the walls of chamber "A" as the gaseous fluid 20 makes up the core. As the polymer solution and gaseous fluid pass through the spinneret "B" and enter the tunnel "C", well oriented, strong discrete fibers 24 are formed.

Figure 4:
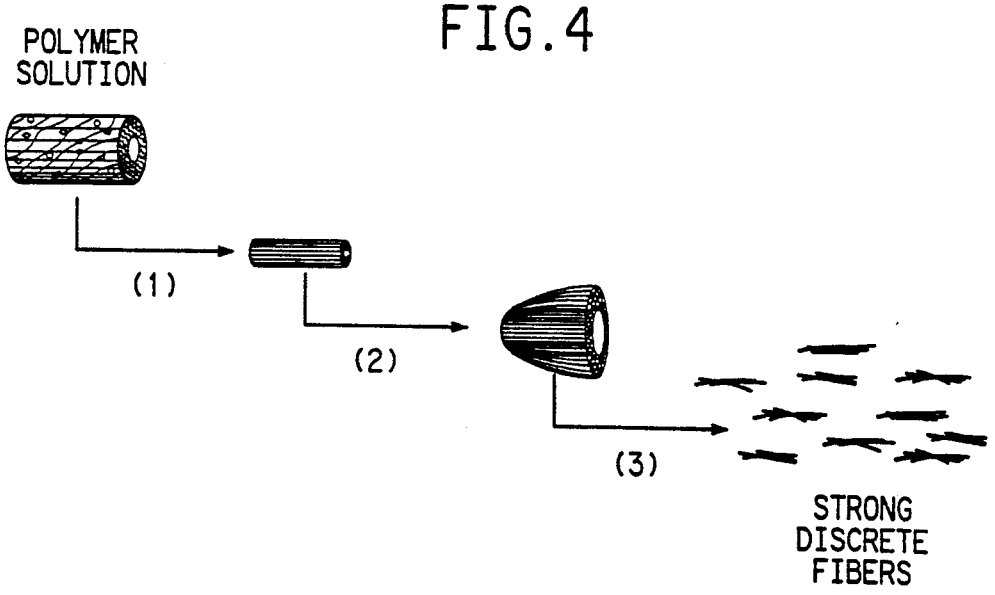
FIG. 4 shows the believed physical state of the polymer used in the assembly of FIG. 3 at various stages in the inventive flash spinning process as it goes from the solution phase to strong, discrete (i.e., discontinuous) fibers.

FIG. 4 diagramatically illustrates how it is believed the polymer solution physically changes as it passes through the preferred spinneret assembly of FIG. 3. As the polymer solution moves along the walls of chamber "A" a tubular form occurs. Position (1) is at the spinneret, position (2) is at the tunnel entrance and position (3) is at the tunnel exit. The polymer solution enters the spinneret as a tubular form and exits as highly oriented, strong, discrete fibers.

Figure 5:
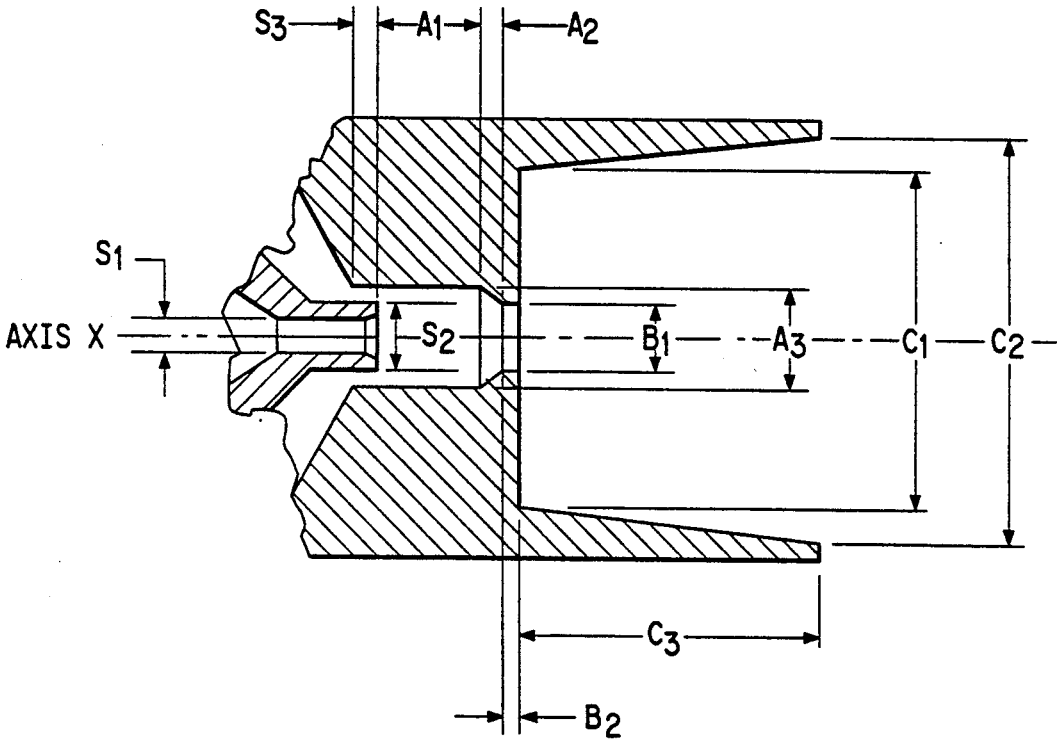
FIG. 5 is an enlarged view of the chamber, spinneret and tunnel of FIG. 3 showing in more detail how the gaseous fluid is injected into the core of the polymer solution.

FIG. 5 shows chamber "A", spinneret "B" and tunnel "C" of FIG. 3 in greater detail. The gaseous fluid is injected into the core of the polymer solution at a pressure substantially equal to the pressure of the polymer solution in order to prevent back flow of either the polymer solution or the gaseous fluid within chamber "A" (i.e., back into the lines supplying polymer solution and gaseous fluid). The gaseous fluid is injected parallel and in the same direction (i.e., along axis "X") as the flow of the polymer solution as it travels towards spinneret "B". Specific dimensions for $A_1$, $A_2$, $A_3$, $B_1$, $B_2$, $C_1$, $C_2$, $C_3$, $S_1$, $S_2$, $S_3$ for the Examples to follow are provided in Table 2.

In use, the invention requires that the polymer solution enter chamber "A" of FIG. 3 along the walls of the chamber. The gaseous fluid enters chamber "A" in the center. The function of chamber "A" is to produce a polymer solution film in a tubular form where the outside of the tube is attached to the stationary walls of the chamber while the core of the tube contains gaseous fluid moving in the same direction as the polymer solution, i.e. axis "X" as shown in FIG. 5.

Turbulence inside chamber "A" is low enough to maintain continuity of the thin-walled polymer solution film tube inside the chamber. Because of this, it is necessary that both the polymer solution and the gaseous fluid enter chamber "A" in the same direction. Supply pressure of the gaseous fluid is balanced with the pressure of the polymer solution to prevent back flow in chamber "A". This also helps in preventing premature flashing of polymer solution inside chamber "A".

Polymer solution along the chamber walls then smoothly converges and enters spinneret "B" as shown in FIGS. 3 and 5. The gaseous fluid at the core of the polymer solution tube accelerates to its sonic velocity at spinneret "B" causing very high shear to the slower moving polymer solution that has been moving along the stationary chamber walls. The need for very high shear is the reason the gaseous fluid must be a vapor or a gas and not a liquid when the polymer solution and gaseous fluid reach the spinneret "B". Average polymer solution velocity at spinneret "B" may vary from about 2 ft./sec. to as high as about 600 ft./sec. while the gaseous fluid velocity may vary from about 100 ft./sec. to as high as about 4000 ft./sec. at spinneret "B". However, under most circumstances, the gaseous fluid velocity will be at least 2× (preferably at least 4×) the polymer solution velocity at the spinneret.

The high shear makes the wall of the thin-walled solution film tube emerging out of spinneret "B" even thinner, which is highly desirable for fragmentation at later stages. This shear also helps in improving polymer chain orientation for improved fiber strength. Turbulence at spinneret "B" is low enough to ensure integrity of the thin-walled solution film tube emerging out of spinneret "B".

The very thin-walled solution film tube, having a jet of gaseous fluid at sonic velocity at the core, then exits spinneret "B" and enters tunnel "C" as shown in FIG. 3. Since pressure inside tunnel "C" is significantly lower than the upstream pressure and is very close to atmospheric pressure, the spin agent within the polymer solution starts flashing. The flashed spin agent vapor, along with other vapors/gases, moving at extremely high velocity (sometimes supersonic speed) inside the tunnel induces a high level of polymer chain orientation in the resulting polymer matrix. Due to the flashing process, the polymer matrix starts cooling rapidly.

At the same time, the gaseous fluid moving at sonic velocity within the core of the polymer solution film tube starts expanding laterally as it enters tunnel "C". The lateral expansion of the gaseous fluid initiates intense turbulence inside tunnel "C". Interferences between spin agent vapor and gaseous fluid can also play a major role in initiating intense turbulence. This intense turbulence fragments the highly oriented polymer matrix making up the thin film just before the matrix can freeze into continuous fibers. As a result, strong, discrete fibers are produced rather than strong continuous fibers as a result of the flash spinning process.

It is important to make sure that turbulence fragments the polymer matrix immediately after the matrix has gone through polymer chain orientation. If fragmentation occurs too early, then the discrete fibers will be weak. If the fragmentation step is delayed, then the highly oriented polymer matrix will freeze into strong, continuous fibers rather than strong, discrete fibers. The exact moment of fragmentation can be controlled by the rate of lateral expansion of the gaseous fluid inside tunnel "C".

The degree of fragmentation depends on the mass ratio of gaseous fluid to polymer. If this mass ratio is too small, than fragmentation will be poor and continuous fibers will be produced. If the ratio is too high, than fragmentation will be premature due to enhanced turbulence prior to completion of polymer matrix orientation. The later will produce weak discrete fibers. Typically, the mass ratio of gaseous fluid to polymer may vary from 0.01 to as high as 100. However, the preferred range for the mass ratio is between 0.1–10.

Exact dimensions for tunnel "C", spinneret "B" and chamber "A" will depend on the polymer solution and gaseous fluid flow rates, polymer solution and gaseous fluid flow characteristics and desired characteristics of the resulting discrete fibers (strength, length, fineness, surface area, etc.). Various dimensions and configurations are set forth in Table 2 which follows.

The polymer solution entering chamber "A" is set at process conditions similar to the polymer solution entering a standard flash spinning process for making continuous fibers and may be single phase or two phase. The various solution types and solution conditions for flash spinning will in general be as described in U.S. Pat. Nos. 3,081,519 and 3,227,794, the contents of which are incorporated herein.

In order to further describe the inventive method and the resulting discrete fibers, the following examples are provided for illustrating, but not for limiting, the invention. Polymer solution and gaseous fluid parameters for Examples 1–13 are set forth in Table 1 which follows.

EXAMPLES

Example 1

A 6 wt. % solution of high density polyethylene, Alathon 7026 commercially available from Occidential Chemical Corporation of Houston, Tex., (hereinafter "HDPE") was prepared in a trichlorofluoromethane (hereinafter "F-11") spin agent at a temperature of 170° C. and a pressure of 1900 psig. The initial polymer solution temperature (P.S. Temp.) and pressure (P.S. Press.) recorded in Table 1 were measured in the supply line before the polymer solution was introduced into chamber "A". The solution pressure was then dropped to 930 psig to create a two phase mixture. At that point, almost pure F-11 spin agent liquid in the form of droplets was dispersed in the continuous, polymer-rich solution phase. This two phase solution was then introduced into chamber "A" along the walls of chamber.

A gaseous fluid (compressed nitrogen) was injected into the center of chamber "A" in a parallel direction to that of the HDPE solution. The gaseous fluid temperature (G.F. Temp.) and pressure (G.F. Press.) recorded in Table 1 (Con't) were measured in the supply line before the gaseous fluid was injected into chamber "A". The dimensions of chamber "A" and spinneret "B" used in this Example are depicted in FIGS. 3 and 5 and are provided in Table 2. The tunnel "C" was not used at the exit of the spinneret "B" during this Example. During the Example, the HDPE polymer flow rate achieved was about 115 lbs/hr and the nitrogen flow rate was about 125 lbs/hr. The method produced very well fibrillated open discrete fibers having an average length of about 0.089 inches (2.24 mm). Fiber characterization (e.g. zero span strength, fineness and surface area data) is provided in more detail in Table 3.

Example 2

In this Example, solution preparation and equipment set-up were the same as Example 1, except that the HDPE solution was introduced into the center of the chamber "A"while the gaseous fluid was injected along the walls of chamber "A" (i.e., HDPE solution was surrounded by gaseous fluid (nitrogen) at the entrance of chamber "A"). During this Example, almost continuous fibers were produced.

Example 3

In this Example, solution preparation and equipment set-up were the same as Example 1, except that the spinneret thickness ($B_2$) was reduced by 0.055 inch to reduce the effective 1/d ratio. During the Example, the HDPE polymer flow rate and gaseous fluid flow rate were similar to Example 1, however, the discrete fibers produced by this Example were stronger and finer than the fibers of Example 1. Fiber characterization is given in more detail in Table 3.

Example 4

In this Example, solution preparation and equipment set-up were the same as Example 3, except that during this Example a tunnel "C" was added at the exit of spinneret "B". Details for chamber "A", spinneret "B" and tunnel "C" are depicted in FIGS. 3 and 5 and are provided in Table 2. During this Example, the HDPE polymer flow rate and gaseous fluid flow rate were similar to Example 3, however, the discrete fibers produced by this Example were finer and even stronger than the discrete fibers produced by Example 3. Fiber characterization is given in more detail in Table 3.

Example 5

In this Example, solution preparation and equipment set-up were the same as Example 4. Fiber characterization is given in more detail in Table 3.

Example 6

In this Example, solution preparation and equipment set-up were the same as Example 5, except that the gaseous fluid employed was 400 psig saturated steam instead of nitrogen. During this Example, the HDPE polymer flow rate was similar to Example 5, however, some back flow of HDPE polymer solution into the steam supply line occurred. The fibers formed were very well fibrillated and open, but produced some fines (very short discrete fibers, 0.1–0.5 mm) possibly due to wet steam. Fiber characterization is given in more detail in Table 3.

Example 7

In this Example, solution preparation and equipment set-up were the same as Example 6, except that the gaseous fluid entrance flow area was increased by about 2.25×. The fibers formed were slightly weaker than Example 6. Fiber characterization is given in more detail in Table 3.

Example 8

In this Example, an 8 wt. % HDPE solution concentration was used. Solution temperature was 173° C. and pressure was 1900 psig. Solution pressure was dropped to 930 psig to create a two phase solution prior to entering chamber "A". 400 psig saturated steam was used as the gaseous fluid. Dimension details about chamber "A", spinneret "B" and tunnel "C" are depicted in FIGS. 3 and 5 and provided in Table 2. In use, polymer solution entered chamber "A" along the walls of chamber "A" while gaseous fluid entered chamber "A" in the center. Strong, long discrete fibers having a fiber length of between 1–25 mm (0.04–1.0 inches) were produced. Fiber characterization is given in more detail in Table 3.

Example 9

In this Example, polymer solution preparation and equipment set-up were the same as Example 3, except that liquid water was used instead of compressed nitrogen gas. Details about equipment set-up are depicted in FIGS. 3 and 5 and provided in Table 2. Discrete fibers produced during this Example were weak and coarse. Fiber characterization is given in more detail in Table 3.

Example 10

In this Example, the HDPE solution concentration was 8 wt. % and the solution temperature was 173° C. All other process variables and set-up conditions were the same as Example 9 (i.e., liquid water was used instead of compressed nitrogen gas). Discrete fibers produced during this Example were weak and coarse similar to Example 9. Fiber characterization is given in more detail in Table 3.

Example 11

In this Example, HDPE solution concentration and equipment set-up were the same as Example 4, except that chamber "A" opened up straight into tunnel "C". Details about equipment set-up are depicted in FIGS. 3 and 5 and provided in Table 2. Fiber characterization is given in more detail in Table 3.

Example 12

In this Example, HDPE solution concentration was 8 wt. % and the solution temperature was 173° C. All other process parameters and equipment set-up were the same as Example 11. Product characterization is given in more detail in Table 3.

Example 13

In this Example, HDPE solution preparation and equipment set-up were the same as Example 11, except that the length of chamber "A" ($A_1$) was only 0.025 inch. Details about equipment set-up are depicted in FIGS. 3 and 5 and provided in Table 2. Fiber characterization is given in more detail in Table 3.

TABLE 1

| Example No. | Polymer | Spin Agent | Polymer Conc. (wt. %) | P.S. Temp. °C. | P.S. Press. psig |
|---|---|---|---|---|---|
| 1 | HDPE | F-11 | 6.0 | 170 | 1900 |
| 2 | HDPE | F-11 | 6.0 | 170 | 1900 |
| 3 | HDPE | F-11 | 6.0 | 170 | 1900 |
| 4 | HDPE | F-11 | 6.0 | 170 | 1900 |
| 5 | HDPE | F-11 | 6.0 | 170 | 1900 |
| 6 | HDPE | F-11 | 6.0 | 170 | 1900 |
| 7 | HDPE | F-11 | 6.0 | 170 | 1900 |
| 8 | HDPE | F-11 | 8.0 | 173 | 1900 |
| 9 | HDPE | F-11 | 6.0 | 170 | 1900 |
| 10 | HDPE | F-11 | 8.0 | 173 | 1900 |
| 11 | HDPE | F-11 | 6.0 | 170 | 1900 |
| 12 | HDPE | F-11 | 8.0 | 173 | 1900 |
| 13 | HDPE | F-11 | 6.0 | 170 | 1900 |

| Example No. | Gaseous Fluid | G.F. Temp. °C. | G.F. Press. psig |
|---|---|---|---|
| 1 | Nitrogen | 20.0 | 1100 |
| 2 | Nitrogen | 20.0 | 1100 |
| 3 | Nitrogen | 20.0 | 1100 |
| 4 | Nitrogen | 20.0 | 1100 |
| 5 | Nitrogen | 20.0 | 1100 |
| 6 | Steam | 230.0 | 400 |
| 7 | Steam | 230.0 | 400 |
| 8 | Steam | 230.0 | 400 |
| 9 | Water | 20.0 | 1100 |
| 10 | Water | 20.0 | 1100 |
| 11 | Steam | 230.0 | 400 |
| 12 | Steam | 230.0 | 400 |
| 13 | Steam | 230.0 | 400 |

TABLE 2

| Example | Chamber "A" | | | Spinneret "B" | | Tunnel "C" | | | Supply | | |
|---|---|---|---|---|---|---|---|---|---|---|---|
| No. | $A_1$ | $A_2$ | $A_3$ | $B_1$ | $B_2$ | $C_1$ | $C_2$ | $C_3$ | $S_1$ | $S_2$ | $S_3$ |
| 1 | .105 | .009 | .140 | .110 | .085 | — | — | — | .040 | .100 | .037 |

TABLE 2-continued

| Example | Chamber "A" | | | Spinneret "B" | | Tunnel "C" | | | Supply | | |
|---|---|---|---|---|---|---|---|---|---|---|---|
| No. | $A_1$ | $A_2$ | $A_3$ | $B_1$ | $B_2$ | $C_1$ | $C_2$ | $C_3$ | $S_1$ | $S_2$ | $S_3$ |
| 2 | .105 | .009 | .140 | .110 | .085 | — | — | — | .040 | .100 | .037 |
| 3 | .105 | .009 | .140 | .110 | .030 | — | — | — | .040 | .100 | .037 |
| 4 | .105 | .009 | .104 | .110 | .030 | .576 | .624 | .300 | .040 | .100 | .037 |
| 5 | .105 | .009 | .140 | .100 | .030 | .500 | .624 | .300 | .040 | .100 | .037 |
| 6 | .105 | .009 | .140 | .110 | .030 | .576 | .624 | .300 | .040 | .100 | .037 |
| 7 | .105 | .009 | .140 | .110 | .030 | .576 | .624 | .300 | .060 | .100 | .307 |
| 8 | .105 | .009 | .140 | .110 | .030 | .500 | .624 | .300 | .050 | .100 | .037 |
| 9 | .105 | .009 | .140 | .110 | .030 | — | — | — | .040 | .100 | .037 |
| 10 | .105 | .009 | .140 | .110 | .030 | .500 | .550 | .300 | .050 | .100 | .037 |
| 11 | .144 | — | .140 | — | — | .576 | .624 | .300 | .060 | .100 | .037 |
| 12 | .144 | — | .140 | — | — | .576 | .624 | .300 | .060 | .100 | .037 |
| 13 | .025 | — | .140 | — | — | .576 | .624 | .300 | .050 | .100 | .037 |

*All dimensions are in inches. $A_3$, $B_1$, $C_1$, $S_1$ and $S_2$ are diameters while $A_1$, $A_2$, $B_2$, $C_3$, $S_3$ are lengths.

TABLE 3

| Example No. | Zero Span(1) Strength (psi) | Fineness(2) (mg/m) | Ave. Length(2) (mm) | Surface(3) Area ($m^2$/gm) |
|---|---|---|---|---|
| 1 | 13.10 | 0.1470 | 2.24 | 8.35 |
| 2 | | continuous fibers | | |
| 3 | 15.34 | 0.1696 | 2.66 | 16.35 |
| 4 | 17.60 | 0.1421 | 2.28 | 8.78 |
| 5 | 16.11 | 0.1581 | 2.38 | 9.57 |
| 6 | 16.36 | 0.1285 | 2.51 | 14.06 |
| 7 | 14.60 | 0.1457 | 2.26 | 8.26 |
| 8 | 18.37 | 0.0974 | 2.31 | 11.94 |
| 9 | 12.10 | 0.1881 | 1.87 | 10.09 |
| 10 | 12.80 | 0.2000 | 1.81 | 7.52 |
| 11 | 11.11 | 0.1217 | 1.84 | 4.45 |
| 12 | 11.70 | 0.1357 | 2.08 | 6.95 |
| 13 | 7.98 | 0.2116 | 1.84 | 5.76 |
| A(4) | 6.99 | 0.2536 | 1.05 | 5.30 |
| B(4) | 6.16 | 0.2288 | 1.03 | 4.60 |
| C(5) | 8.30 | 0.2990 | 1.37 | 7.80 |
| D(5) | 5.70 | 0.3145 | 1.28 | 12.80 |
| E(5) | 6.10 | 0.5240 | 1.44 | 6.40 |

(1)A slurry of 2.533 grams of discrete fibers in 2.0 liters of water was prepared in a 1 gallon Waring Blender at high speed. The mixing time was 2 minutes. A wetting agent (Ethoduomeen T-13 manufactured by Akzo Chemicals, Inc.) was used. The slurry was dewatered in a 8" × 8" head box to prepare a hand sheet. The hand sheet thus prepared was then pressed between water absorbing cardboard under constant roller weight (roller diameter 4", roller width 9.5", roller weight 22 lbs.). The hand sheet was then allowed to dry overnight. Zero span strenth of the dry hand sheet was then measured according to TAPPI method method 231 SU-70 and is reported in psi. Zero span strength was measured using a Pulmac Trouble Shooter manufactured by Pulmac Instruments International of Middlesex, Star Route, Montpellier, VT.

(2)Fineness and average length were measured using a Kajaani FS-100 analyzer manufactured by Kajaani Inc., Norcross, GA. Fineness was measured in mg/m while average length is measured in mm.

(3)Surface area was measured using a Single Point BET Nitrogen Adsorption Technique and is measured in $m^2$/gm.

(4)Comparative Examples A and B were polyethylene pulp commercially available from Mitsui Petrochemicals Industries, Ltd., Tokyo, Japan.

(5)Comparative Examples C, D and E were Pulpex ® polyethylene pulp commercially available from Hercules Incorporated, Wilmington, Delaware.

In addition, when discrete fibers made by the inventive method (i.e., fibers having a zero span strength of at least 13 psi when formed into a 1.6 oz/yd$^2$ wet-laid sheet) were compared to prior art discrete fibers (i.e., Comparative Examples A–E comprising Hercules' Pulpex ® and Mitsui's polyethylene pulps having a zero span strength less than 10 psi when formed into a 1.6 oz/yd$^2$ wet-laid sheet), it was clear that the inventive discrete fibers had higher orientation than the prior art pulps. This was determined through shrinkage testing according to the following method:

A 1.6 oz/yd$^2$ hand sheet was prepared from pulp (discrete fibers) of the invention and from commercially available pulps. The sheet was cut into a 1"×1" square and then dipped in 150° C. oil. After dipping for a reasonable time, so that shrinkage could occur, the area of the paper was measured. The shrinkage area ratio was then determined by dividing the original area (i.e., 1 in$^2$) by the area after oil treatment. The shrinkage area ratio for the inventive pulps was between 7 and 8 while the shrinkage area ratio for the commercially available pulps was between 4 and 5. This indicates that the inventive pulps shrank more than the commercially available pulps, hence they had greater orientation.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. A method of flash spinning strong, discrete polymer fibers having a zero span strength of at least 13 psi when formed into a 1.6 oz/yd$^2$ wet-laid sheet comprising the steps of:

(a) preparing a polymer solution of 4–25 wt. % polymer and 75–96 wt. % flash spinning agent at a temperature between 130° and 260° C. and a pressure between 300 and 2500 psig;

(b) introducing a flow of the polymer solution into the inlet end of a chamber, having an inlet and an outlet end, in a direction parallel to and along the chamber wall, while simultaneously injecting into the center of the chamber at the inlet end a gaseous fluid flowing in the same direction as the polymer solution and at a pressure substantially equal to the pressure of the polymer solution to sufficiently balance the polymer solution pressure so that back flow does not occur within the chamber, the gaseous fluid being injected into the chamber in a direction parallel to the flow direction of the polymer solution; and (c) flash spinning the polymer solution and the gaseous fluid coaxially from the outlet end of the chamber through a spinneret constriction into a region of substantially lower pressure and temperature with the gaseous fluid flowing at a velocity at least two times greater than the velocity of the polymer solution when the gaseous fluid and polymer solution pass through the spinneret.

2. The method of claim 1 wherein the polymer is selected from the group consisting of high density polyethylene and high density polypropylene.

3. The method of claim 1 wherein the gaseous fluid is selected from the group consisting of nitrogen, air, argon and steam.

4. The method of claim 1 wherein the gaseous fluid is at a velocity at least four times greater than the velocity of the polymer solution when the gaseous fluid and polymer solution pass through the spinneret.

5. Discrete fibers produced by the method of any of claims 1–4 wherein the fibers have a zero span strength of at least 13 psi when formed into a 1.6 oz/yd$^2$ wet-laid sheet.

6. The method of claim 1 wherein the mass ratio of gaseous fluid to polymer is between 0.01 to 100.

7. The method of claim 6 wherein the mass ratio is between 0.1 to 10.

* * * * *